US007500647B2

(12) United States Patent
Lefferson et al.

(10) Patent No.: US 7,500,647 B2
(45) Date of Patent: Mar. 10, 2009

(54) JAR HOLDER

(76) Inventors: Peter Lefferson, 6101 7 Ave. N., St. Petersburg, FL (US) 33710-7015; Kathleen Langan Lefferson, 6101 7 Ave. N., St. Petersburg, FL (US) 33710-7015

( * ) Notice: Subject to any disclaimer, the term of this patent is extended or adjusted under 35 U.S.C. 154(b) by 301 days.

(21) Appl. No.: 11/564,322

(22) Filed: Nov. 29, 2006

(65) Prior Publication Data

US 2007/0295876 A1 Dec. 27, 2007

Related U.S. Application Data

(60) Provisional application No. 60/805,400, filed on Jun. 21, 2006.

(51) Int. Cl.
*A47K 1/08* (2006.01)

(52) U.S. Cl. ..... 248/311.2; 81/3.32; 248/214

(58) Field of Classification Search ..... 248/313, 248/214, 311.2; 81/3.32
See application file for complete search history.

(56) References Cited

U.S. PATENT DOCUMENTS

| | | | | | |
|---|---|---|---|---|---|
| 826,294 | A | * | 7/1906 | Waldschmidt | 248/310 |
| 901,618 | A | * | 10/1908 | Honstein | 81/3.32 |
| 1,227,738 | A | * | 5/1917 | Bellis et al. | 81/3.32 |
| 1,826,486 | A | * | 10/1931 | Walker | 141/88 |
| 1,912,500 | A | * | 6/1933 | Rutledge | 81/3.32 |
| 2,531,052 | A | * | 11/1950 | Kehoe | 81/3.32 |
| 2,569,239 | A | * | 9/1951 | Holmen | 81/3.32 |
| 4,964,605 | A | * | 10/1990 | Beyer et al. | 248/311.3 |

* cited by examiner

*Primary Examiner*—J. Allen Shriver, II
*Assistant Examiner*—Erin Smith

(57) ABSTRACT

One of the greatest frustrations in the kitchen for a person with limited hand mobility is the task of holding the body of a jar while removing the lid. The present invention solves this problem by allowing the handicapped person's body to become the third hand and hold the bottle in a rigid grip. The new device clips over the front of any standard kitchen drawer and traps the jar between a V shaped vertical support and the front of the counter top. The jar is held rigid when the user presses their body against the drawer. Now both hands are free to remove the jar lid by any common means.

4 Claims, 2 Drawing Sheets

JAR HOLDER

BACKGROUND OF INVENTION

1. Field of Invention

The present invention relates to holding the body of jars and bottles while conventional jar and bottle lid removing devices are used to remove the lid.

2. Prior Art

One of the greatest frustrations in the kitchen for a person with limited hand mobility is the task of opening jars and bottles. To solve this problem many devices have been invented and marketed that grasp the jar lid or bottle top thus allowing the handicapped person to apply greater torque to the lid. But now, what is holding the jar or bottle?

The present invention solves this problem by allowing the handicapped person's body to become the third hand and hold the bottle in a rigid grip. The new device attaches to the front of any standard kitchen drawer with an inverted U shaped clip. Fastened to the top of this U shaped clip is a vertical wall in the shape of the letter V such that a jar may be secured between the inside of the V and the front edge of the counter top when the drawer is partially open. There is also a rubber material inside this V to prevent the jar from turning when the handicapped person uses their body to push against the drawer. The jar is now securely locked between the V and the counter top. Now, any aforementioned jar lid or bottle top remover device can be used with ease to remove the top.

SUMMARY OF INVENTION

The present invention relates to the problem of holding the body of a jar or bottle while using one of many available jar lid removal devices to remove the top. The invention has an inverted U shaped clip to securely rest on the front edge of an open kitchen counter drawer. Secured to the top of this inverted U shaped clip is a V shaped vertical wall with the V inside facing the counter top front edge. Soft rubber lines the inside of the V. With the drawer partially open a bottle or jar can be place inside the V, resting on the inverted U clip. Now, the jar is rigidly secured when the drawer is closed and the persons body is pressed against it.

DRAWINGS

REFERENCE NUMBERS

Figure 1:
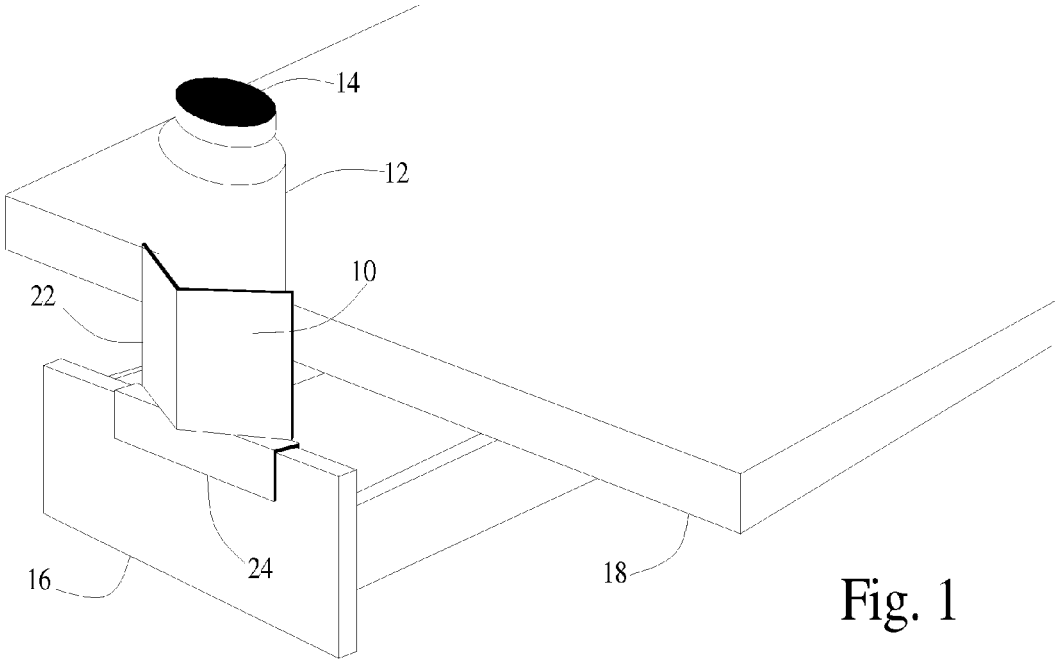
FIG. 1 shows the jar holder with a jar as seen from the front of the jar.

10 jar holder
12 jar
14 jar lid

16 drawer front
18 counter top
20 force pressing the drawer
22 vertical support
24 drawer clip
26 soft clinging material

DETAILED DESCRIPTION

FIG. 1 shows the bottle holder 10 coupled to the top edge of drawer front 16 by means of an inverted U shaped drawer clip 24. Jar 12 is sits between the V shape of vertical support 22 and the front edge of counter top 18.

Figure 2:
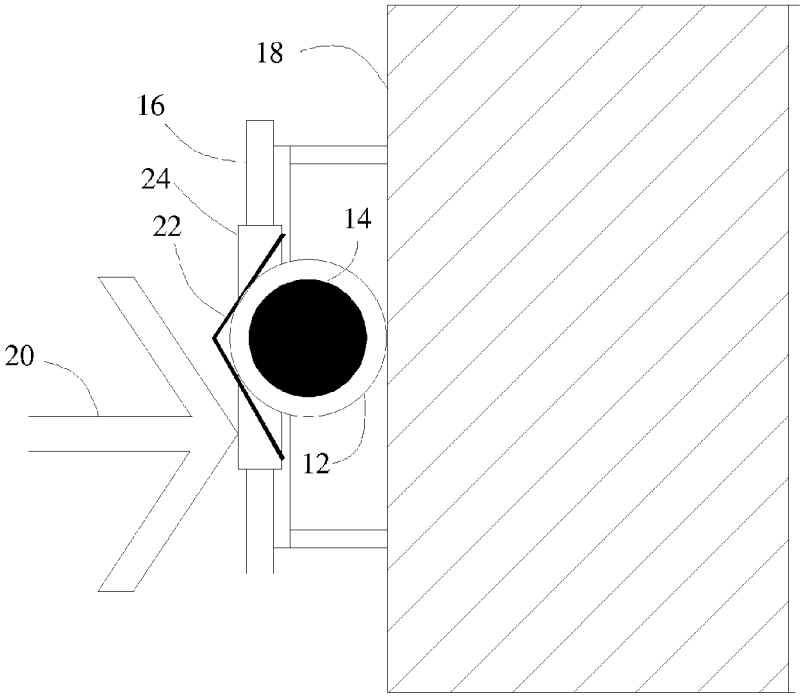
FIG. 2 shows the jar holder with a jar as seen from the top looking down.

FIG. 2. shows again jar 12 pressed between jar holder vertical support 22 and the front edge of counter top 18. Jar 12 is held securely by means of the force pressing the drawer 20. Now, the user's hands are free to remove jar lid 14 by any conventional means.

Figure 3:
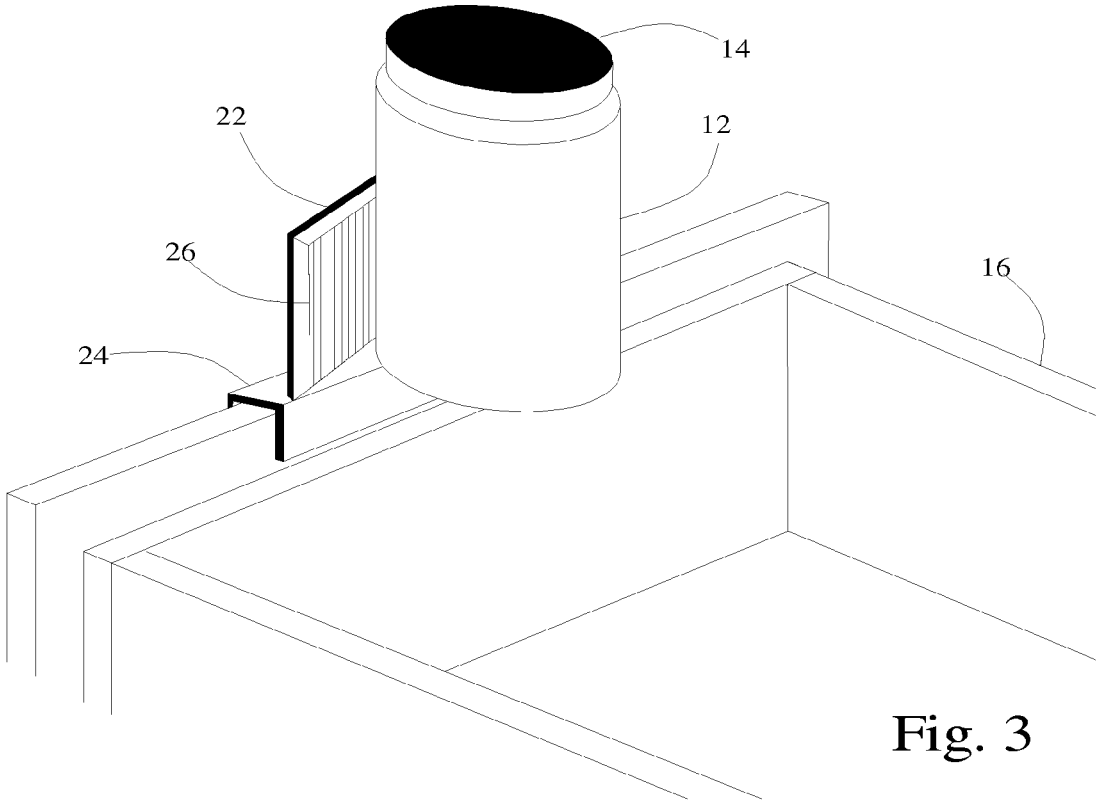
FIG. 3 shows the jar holder with a jar as seen from the open drawer.

FIG. 3. shows again jar 12 resting on top of the inverted U shaped drawer clip 24 and against the jar holder vertical support 22. It also shows the soft clinging material 26 that lines the vertical support 22 that provides additional friction for holding the jar 12 when the jar lid 14 is twisted.

What is claimed is:

1. A jar holding device for allowing a person to have both hands free to remove the jar lid comprising:

a means to attach said jar holding device to the top vertical front of a partially open common kitchen drawer, a means to support the side of the jar on top of said vertical drawer front thus preventing said jar from falling, wherein said means to support the side of the jar includes a vertical wall lined with a material of high friction surface between said vertical wall and the jar thus preventing the jar from turning when the jar lid is turned, and whereby securing said jar between said means to support the side of the jar and the counter top front edge by means of a force supplied by the user's body to the drawer front and directed toward the counter top front edge thus preventing said jar from turning when the jar lids is turned.

2. A jar holding method of claim 1 with a means to couple said jar holder to the top front of a partially open drawer comprising a panel on the front of the drawer front coupled to a panel on the top of the drawer front coupled to a panel on the inside surface of the drawer front thus securing said jar holder to the drawer front.

3. A jar holding method of claim 1 comprising a vertical wall shaped to prevent the jar from falling out of said jar holder.

4. A jar holding method of claim 1 comprising a vertical wall with the shape of the letter V with the valley of said letter V pointing away from said counter top coupled to said means to attach said jar holder to the top front of a partially open common kitchen drawer thus providing at least two contact points inside said V between said vertical wall and the side of the jar.

* * * * *